United States Patent [19]

Young

[11] Patent Number: 4,643,972

[45] Date of Patent: Feb. 17, 1987

[54] METHOD AND APPARATUS FOR MULTIPHASE CONTACTING BETWEEN GAS, SOLID AND LIQUID PHASES

[75] Inventor: Murray M. Young, Waterloo, Canada

[73] Assignee: University of Waterloo, Waterloo, Canada

[21] Appl. No.: 762,686

[22] Filed: Aug. 5, 1985

Related U.S. Application Data

[63] Continuation of Ser. No. 386,052, Jun. 7, 1982, abandoned.

[30] Foreign Application Priority Data

Jun. 5, 1982 [GB] United Kingdom ..... 8117287

[51] Int. Cl.[4] ..... C12M 1/22; C12M 1/08; C12M 1/06

[52] U.S. Cl. ..... 435/252; 435/254; 435/314; 435/315; 435/804; 435/818; 422/227; 422/231; 261/123; 261/124

[58] Field of Search ..... 435/287, 313, 314, 315, 435/316, 252, 105, 99, 813, 242, 253, 254, 804, 818; 210/221.2, 219, 220; 261/124, 36, 123; 422/227, 228, 230, 231

[56] References Cited

U.S. PATENT DOCUMENTS

| | | | |
|---|---|---|---|
| 3,439,807 | 9/1966 | Danjes | 210/629 |
| 3,536,305 | 10/1970 | Lefraneois | 210/220 |
| 3,807,565 | 4/1974 | Langston | 210/220 |
| 4,263,143 | 4/1981 | Ebner et al. | 435/314 |
| 4,290,885 | 9/1981 | Kwak | 210/220 |

FOREIGN PATENT DOCUMENTS

| | | | |
|---|---|---|---|
| 0028441 | 3/1979 | Japan | 210/220 |

*Primary Examiner*—David M. Naff
*Assistant Examiner*—William J. Herald
*Attorney, Agent, or Firm*—Sim & McBurney

[57] ABSTRACT

Multiphase contacting between gas, solid and liquid phases is effected using a novel apparatus comprising a cylindrical vessel, a draft tube, a conical bottom and a gas-sparger system. Mild and uniform mixing is achieved within the novel apparatus while stagnant zones and zones of high shear within the vessel are eliminated. Gas-liquid mass transfer is achieved at rates comparable to conventional high-shear mechanically-stirred devices while the efficiency of liquid mixing in the vessel is better than conventional low-shear pneumatically-stirred devices. The apparatus is preferably used in fermentation processes.

5 Claims, 2 Drawing Figures

METHOD AND APPARATUS FOR MULTIPHASE CONTACTING BETWEEN GAS, SOLID AND LIQUID PHASES

This is a continuation of application Ser. No. 386,052 filed June 7, 1982, now abandoned.

FIELD OF INVENTION

The present invention relates to apparatus and method for carrying out multiphase contacting in liquids for the promotion of physical, chemical or biological changes, more particularly bioconversion and biotransformation processes, as in fermentation and enzymatic processes, utilizing such apparatus.

BACKGROUND TO THE INVENTION

Particulate solids, such as, microbial, animal or plant cells or their components attached to artificial carriers, or nutrient substrates, are involved in many useful and potentially useful bioconversion or biotransformation processes. In carrying out such processes, it is often essential to contact the solid particles with a liquid phase to permit biochemical reactions involving components contained in the solids and in the liquid phase to occur. It also may be essential for a gas solute, for example, oxygen, to be transferred from a gas phase, such as, air, into the liquid medium. In addition, the processes may need to be carried out under mild conditions of mixing and agitation in order to avoid deleterious effects, such as, cellular damage or excessive use of energy for mixing and/or aeration.

In the prior art, such bioconversion or biotransformation processes are accomplished in reactor devices which normally employ simple mechanically-stirred or pneumatically-stirred vessels. These prior art devices, however, suffer from one or more of several drawbacks, including the accumulation of particulate solids in unmixed stagnant zones in the vessel, the growth of organisms in crevices and other stagnant-zone or poorly mixed regions of the vessel, the development of foam at the top of the aerated medium, and damage and destruction of biological cells by higher shear and excessive use of energy for mixing and/or aeration.

SUMMARY OF INVENTION

In accordance with the present invention, these prior art problems are overcome by effecting the procedures in a uniquely-constructed vessel. The apparatus of the invention enables there to be achieved solids deposit-free bioconversion and/or foam-free bioconversion and/or mild agitation bioconversions, as well as other physical and/or chemical reactions.

In accordance with the present invention, there is provided an apparatus for effecting multiphase contacting between gas, solid and liquid phases, comprising an upright vessel containing liquid medium and particulate material, a gas sparger to admit at least one gas to the liquid medium in the vessel, and circulation inducing means within the vessel to effect mild and uniform mixing and to ensure the absence of stagnant zones within the vessel and the avoidance of zones of high shear. The present invention also includes a method of effecting multiphase contacting using the apparatus.

DESCRIPTION OF PREFERRED EMBODIMENT

Figure 1:
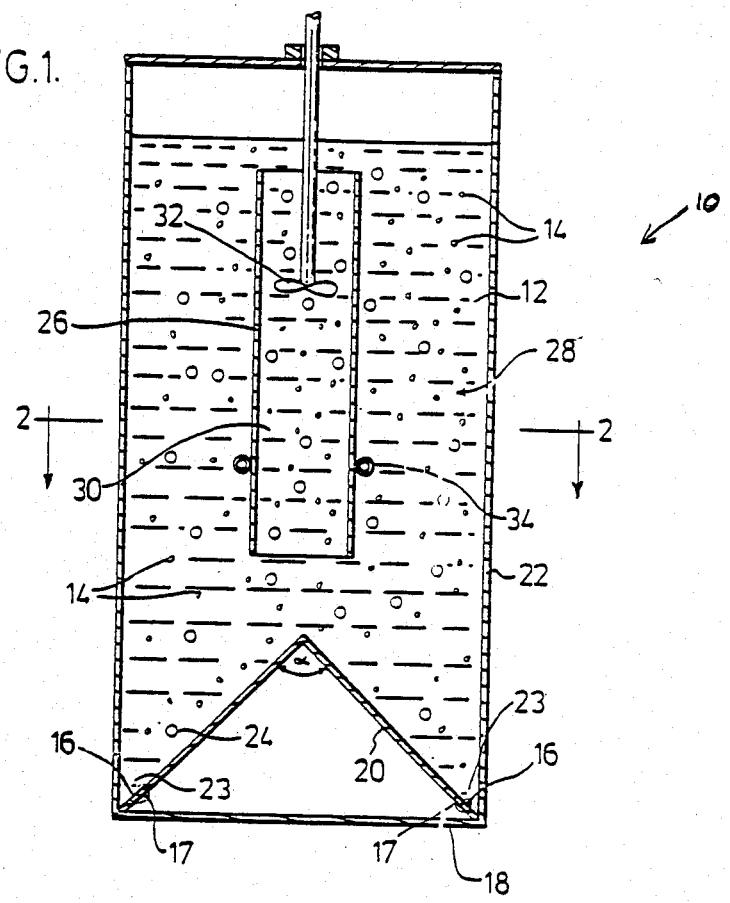
FIG. 1 is a schematic elevational view of a reactor apparatus provided in accordance with one embodiment of the invention.
Figure 2:
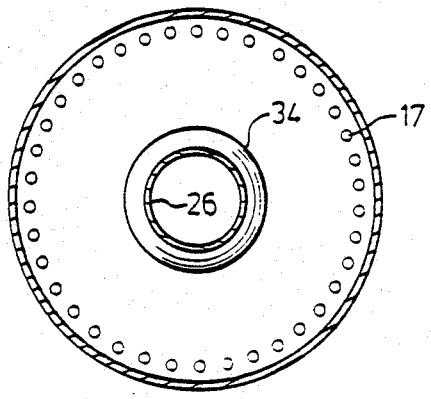
FIG. 2 is a plan view of the reactor apparatus of FIG. 1.

Referring to the drawings, which illustrate the current best mode of carrying out the invention known to the applicant, an upright generally right-cylindrical reactor vessel 10 houses a liquid phase medium 12 which contains solid particulates 14. The solid particulates 14 may be any substance which contains one or more components capable of undergoing physical, chemical or biochemical reactions with components of the liquid medium 12. Such substances include solid cellulosic substrates, metal-bearing ores, cells of microbes, plants or animals, or artificially-immobilized enzymes.

The liquid medium 12 may contain one or more components capable of undergoing chemical or biochemical reactions with components of the solid particulates 14. The liquid phase reaction medium, for example, may comprise an aqueous nutrient medium for fermentation containing dissolved salts, sugars and other components commonly used in fermentation media.

The reactor vessel 10 may be of any convenient dimension and usually has a height-to-diameter ratio in the range of about 1:1 to about 4:1, preferably about 3:1.

A gas sparger 16 for the introduction of at least one gas, takes the form of an array of orifices 17 located around the outer perimeter of the base 18 of the reactor vessel 10. The orifices 17 may have any convenient diameter, generally from about 0.05 to about 1 cm, typically about 0.3 cm, and may be spaced apart any convenient distance, usually about 1 to about 10 cm, typically about 1.25 cm. Any other convenient form of gas sparger 16, such as, a perforated hollow ring, may be provided. Additional aeration and/or agitation may be effected, if desired, by the use of two or more such gas spargers 16.

An inverted cone 20 forms the bottom wall 18 of the reactor vessel 10 and its perimeter is spaced from the upright wall 22 of the reactor 10, so that the orifices 17 of the gas sparger 16 communicate with the crevice 23 which is formed by the bottom and side walls 18, 22 of the reactor 10 and the inverted cone 20. The inverted cone 20 may have any convenient conical angle, usually about 30° to about 90°.

The gas sparger 16 injects gas bubbles 24 through the multiple orifices 17 into the crevice 23 and thereby into the liquid medium 12.

A right cylindrical draft tube 26 is arranged coaxially with the reactor vessel 10 and is located within the liquid medium spaced upwardly from the inverted cone 20, inwardly from the reactor side wall 22 and downwardly from the surface of the liquid medium 12 in the reactor 10.

The draft tube 26 has a diameter such that the ratio of the diameter of the vessel 10 to the diameter of draft tube 26 is usually about 2:1 to about 5:1, preferably about 4:1. The draft tube 26 may be spaced upwardly from the inverted cone 20 and downwardly from the upper level of liquid medium 12 any convenient distance, typically about the same distance. Generally, the distance is about 5 to about 10 cm.

The draft tube 26 separates the interior of the reactor vessel 10 into concentric flow channels 28 and 30 through which the reaction medium 12 flows in opposite directions. The draft tube 26 provides a clear demarkation between the flow channels and prevents cross-mixing.

An axial downflow-type impeller 32, for example, a propeller, may be located within the flow channel 30 to assist in the suppression of foam formation and a supplementary ring sparger 34 may be located between the outer wall of the draft tube 26 and the inside wall of the reactor vessel 10 to increase the gas flow to the liquid medium 12. A heat exchanger (not shown) also may be associated with the draft tube 26 to enable the liquid medium 12 to be heated or cooled, as required.

OPERATION

In operation, a gas, usually air where an aerobic reaction is required, or an inert gas where an anaerobic reaction is required, is fed into the reactor vessel 10 through the gas sparger 16, thereby forming the gas bubbles 34 in the crevices 23. The gas bubbles 24 rise in the crevices 23, thereby clearing and cleaning the crevices 23 of any particulate solids which may settle therein.

The gas bubbles pass into the outer annular flow channel 28 and create a hydrostatic pressure difference between the contents of the annular flow channel 28 and the inner flow channel 30. A suction effect is created within the inner flow channel 30, thereby causing the reaction medium 12 in the outer annular channel 28 to flow upwardly until it clears the upper edge of the draft tube 26, to flow downwardly through the inner channel 30 until it clears the bottom edge of the draft tube 26, and then to flow once again into the annular channel 28. This circulatory flow motion of the liquid reaction medium 12, which may carry within it the suspended solids 14 and gas bubbles 24 is illustrated by arrows in FIG. 1.

The suction effect created within the inner flow channel 30 may be enhanced by the action of the impeller 32. The impeller 32 also assists in liquid recirculation within the reactor 10. More than one such impeller 32 may be utilized, depending on the vertical height of the vessel and the intensity of the recirculation required.

The suction effect in the inner flow channel 30 carries any undesirable foam which may form on the surface of the reaction medium 12 in the reactor 10 into the bulk liquid below the surface where the foam is destroyed by re-dissolution and/or bubble coalescence.

Additional aeration and/or agitation may also be effected, if desired, by the utilization of one or more supplementary ring spargers 34. The orifices of this sparger 34 are arranged to eject gas radially outwardly thereof so that small preformed bubbles are readily detached by the upward fluid flow in the channel 28.

The reactor vessel 10 may be used for carrying out a wide variety of bioconversion and biotransformation processes in a manner which overcomes the prior art problems of mechanically stirred vessels. The entry of the gas to the reactor vessel 10 and the thorough and uniform mixing of the solid phase and liquid phase within the reactor vessel 10 prevents the accumulation of particulate solids in unmixed stagnant zones and the growth of cellular biomass in crevices and other stagnant zones or poorly mixed regions of the reactor vessel 10. The induced suction in the channel 30 eliminates foam accumulation on the surface of the liquid medium 12 and produces only low shear forces on biological cells, so that damage or destruction of the cells by shear forces is eliminated. In this way, considerably enhanced microbial growth can be achieved using this invention.

The bioconversion or biotransformation process which is effected using the apparatus of the invention may be a fermentation process using any desired organism, for example, aerobic fermentation using *Chaetomium cellulolyticum* (ATCC No. 32319).

Where the latter organism is used for the fermentation, the particulate solid phase material 14 usually is a cellulosic-containing material to provide carbon nutrient for the organism growth. The cellulosic-containing material may be any convenient cellulosic material, such as, wheat straw, corn stover or Kraft paper pulp mill clarifier waste sludge. The cellulosic material usually is in the form of particulate solids of up to about 2 cm particle mesh size.

The cellulosic material may be provided in any convenient concentration for carrying out the fermentation usually up to about 5% w/v (weight per unit volume).

The flow rate of gas through the sparger 16 into the reactor 10 may be any convenient value, depending on the process which is being effected in the reactor vessel 10. Usually, the gas flow rate is in the range of up to about 2 volumes of gas per volume of liquid medium per minute.

Gas-liquid mass transfer is achieved in the vessel 10 at rates comparable to conventional high shear mechanically-stirred devices. Further, the efficiency of liquid mixing within the vessel 10 is superior to conventional low-shear pneumatically-stirred devices.

EXAMPLES

Example 1

Using the apparatus of FIG. 1 having a height-to-diameter ratio of 3, microbial biomass in the form of the fungal organism, *Chaetomium cellulolyticum,* was produced by growing it in an aerated aqueous nutrient medium containing 1% particulate solids in the form of chemically pretreated pieces of wheat straw (average mesh size of 2 mm) as the sole carbon source for the fermentation process. The process proceeded with virtually no interference from microbial growth attachments to the vessel walls or bottom or settling out of particulate solids within the device.

By contrast, undesirable cellular disruptions, wall attachments and settling-out of solids leading to about 25% lesser microbial biomass production (of a maximum of about 0.2 grams per liter of medium per day) within the vessel medium occurred for similar experiments carried out in a conventional mechanically stirred tank fermentor of equivalent volume and aeration rates.

Example 2

Repeating the set of comparative experiments in Example 1 but replacing the wheat straw with corn stover, similar better results of microbial biomass productivity (by about 25%) were obtained with the apparatus of FIG. 1.

Example 3

Repeating the set of comparative experiments in Example 1 but replacing the wheat straw with a Kraft paper pulp mill clarifier waste sludge similar better results of microbial biomass productivity (by about 25%) were obtained with the apparatus of FIG. 1.

Example 4

Using the apparatus of FIG. 1, the rate of oxygen transfer from sparged air bubbles into the liquid phase of a typical fermentation medium was measured as an overall mass transfer coefficient of about 120 reciprocal hours. It was found that the oxygen transfer efficiency in terms of power requirements per unit volume of vessel contents was comparable to that obtained in a conventional high-shear mechanically stirred tank fermentor device of the same size and for the same aeration conditions.

Example 5

Using the apparatus of FIG. 1, the volume of air bubbles retained in the liquid phase of a typical fermentation medium was measured as 12% volume of gas per volume of liquid. It was found that a similar gas-bubble retention was obtained in a conventional low shear bubble column of the same size and for the same aeration conditions.

Example 6

Repeating the set of comparative experiments in Example 4 but measuring liquid blending time instead of oxygen transfer rates, it was found that the apparatus of FIG. 1 was superior by 10 to 50% to the conventional bubble column fermentor device for comparable aeration rates.

What I claim is:

1. Apparatus for effecting multiphase contacting between gas, solid and liquid phases, comprising:

an upright cylindrical vessel having a wall, a lower end and an upper end, said vessel having a height-to-diameter ratio of about 1:1 to about 4:1 and being adopted to hold a continuous liquid phase in which particulate solid phase is suspended, gas sparger means at said lower end of said vessel and adjacent said wall thereof for admitting at least one gas in bubble form into said liquid phase at circumferentially-spaced locations around the lower end of the vessel adjacent said wall thereof, said gas sparger means comprising a plurality of orifices formed through a lower closure to said vessel adjacent said vessel wall, said orifices having a diameter of about 0.05 to about 1 cm and are equally circumferentially spaced apart a distance of about 1 to about 10 cm, conical means having an apex extending upwardly within said vessel from the lower end thereof and having a perimeter spaced inwardly from said vessel wall to define therewith a narrow gap wherein said plurality of orifices is located, said conical means having a solid angle of about 30° to about 90°, an upright cylindrical draft tube located within said vessel coaxial therewith and having a lower end and an upper end, the ratio of the diameter of the vessel to the diameter of the draft tube being about 2:1 to about 5:1, the lower end of the draft tube being spaced upwardly a distance of about 5 to about 10 cm from the apex of the conical means and the upper end of the draft tube being spaced downwardly a distance of about 5 to about 10 cm from the intended liquid level in the vessel, liquid downflow impeller means located within and adjacent the upper end of said draft tube, and auxiliary gas sparger means surrounding said draft tube and constructed to inject gas in bubble form radially outwardly thereof into the liquid phase.

2. The apparatus of claim 1 wherein said conical means is an insert located on a lower closure to said vessel.

3. A method of effecting multiphase contacting between gas, solid and liquid phases, comprising:

establishing a continuous liquid phase in which at least one particulate solid phase is suspended in a cylindrical upright mixing zone having a height-to-diameter ratio of about 1:1 to about 4:1, establishing physically separate inner and outer concentric flow paths within said mixing zone which are in fluid flow relationship with one another at the upper and lower ends thereof, the ratio of the diameter of the mixing zone to the diameter of the inner flow path being about 2:1 to about 5:1, providing a lower end closure to said mixing zone comprising an upwardly-extending conical surface having an apex and a narrow-width annular surface between the perimeter of the conical surface and the inner surface of the mixing zone, said conical surface having a solid angle of about 30° to about 90°, feeding at least one gas in bubble form from said annular surface through a plurality of openings having a diameter of about 0.05 to about 1 cm and being equally circumferentially spaced apart a distance of about 1 to about 10 cm around said annular surface at a flow rate of up to about 2 volumes of gas per volume of liquid phase per minute into the continuous liquid phase in the outer one of said concentric flow paths to cause said continuous liquid phase first to flow upwardly therein, then to flow downwardly through the inner one of said concentric flow paths towards said lower end closure and to flow back into said outer flow path while maintaining said solid phase in suspension, whereby continuous flow and contact of gaseous, solid, and liquid phases is achieved within said mixing zone while avoiding stagnant zones and zones of high shear within the mixing zone, impelling said continuous liquid phase downwardly within said inner flow path, the lower end of said inner flow path being spaced upwardly a distance at about 5 to about 10 cm from the apex of the conical surface and the upper end of the inner flow path being spaced downwardly a distance of about 5 to about 10 cm from the liquid phase level in the mixing zone and feeding at least one additional gas in bubble form radially outwardly from around said inner flow path within the outer flow path.

4. The method of claim 3 wherein said gas comprises air, said continuous liquid phase comprises a fermentation medium, and said particulate solids comprise a solid substrate for an organism and the organism, whereby said multiphase contacting permits aerobic fermentation of said organism to occur.

5. The method of claim 4 wherein said particulate solids comprise a cellulosic-containing material and said organism is a cellulolytic organism.

* * * * *